United States Patent [19]

DesNoyers et al.

[11] Patent Number: 4,843,746

[45] Date of Patent: Jul. 4, 1989

[54] OUTDOOR SUPPORT POST APPARATUS

[75] Inventors: Daniel P. DesNoyers, Mocksville; Michael E. Greer, Winston-Salem; Albert J. Aguallo, Mocksville, all of N.C.

[73] Assignee: Signlite Services, Inc., Clemmons, N.C.

[21] Appl. No.: 142,511

[22] Filed: Jan. 11, 1988

[51] Int. Cl.[4] ..... G09F 15/00

[52] U.S. Cl. ..... 40/607; 248/156

[58] Field of Search ..... 40/607, 617; 248/156, 248/533, 159

[56] References Cited

U.S. PATENT DOCUMENTS

| | | | |
|---|---|---|---|
| 3,519,234 | 7/1970 | Matson | 248/156 |
| 4,249,715 | 2/1981 | Repp | 40/607 |
| 4,258,494 | 3/1981 | Borque | 40/607 |
| 4,326,352 | 4/1982 | Barth | 40/607 |
| 4,327,514 | 5/1982 | Bourque | 40/607 |
| 4,378,650 | 4/1983 | Ottoson | 40/607 |
| 4,483,506 | 11/1984 | Litwiller | 248/156 |
| 4,524,533 | 6/1985 | Still, Jr. | 248/156 |
| 4,667,829 | 5/1987 | Edmund-White | 40/607 |

FOREIGN PATENT DOCUMENTS

| | | | |
|---|---|---|---|
| 3003426 | 8/1981 | Fed. Rep. of Germany | 40/607 |

*Primary Examiner*—John J. Wilson
*Assistant Examiner*—Cary E. Stone
*Attorney, Agent, or Firm*—Shefte, Pinckney & Sawyer

[57] ABSTRACT

An outdoor sign post apparatus adapted for selective assembly and disassembly, utilizes an anchor ground rod, a base post member with a central longitudinal opening for mounting on the ground rod, an extension post member for telescopical mounting to the base post member in alignment therewith, and a cross post member compatibly notched with the extension post member for mounting thereto in substantially perpendicular relationship. The components of the sign post apparatus are easy to erect and dismantle and to readily transport so as to facilitate repeated temporary use thereof.

14 Claims, 3 Drawing Sheets

OUTDOOR SUPPORT POST APPARATUS

BACKGROUND OF THE INVENTION

The present invention relates to post-like apparatus such as commonly utilized for erecting signs and, more particularly, to an outdoor support post apparatus particularly adapted for selective assembly and disassembly to facilitate repeated temporary use.

In recent years in the United States, the marketing and sale of homes and other single family dwellings have become increasingly competitive as major real estate brokerage firms have quickly expanded nationwide through franchising. As a result, the manner in which real estate is advertised has become increasingly important. As part of this new awareness and attention to marketing, real estate brokerages have designed and put into use distinctive, personalized styles of on-site property sale signs. By way of example, the nationwide chain of Merrill Lynch real estate brokerage firms currently utilizes a distinctive wooden sign post assembly the design and configuration of which is readily recognizable. Other real estate brokerage firms across the country have adopted the same or highly similar signs.

While such signs provide a marked improvement in construction and appearance over the more simplistic signs previously in widespread use, these new signs are significantly more expensive and cumbersome to use. Typically, the aforedescribed signs are fabricated of conventional "four-by-four" wooden posts, including a vertical post member approximately four to six feet in height and a horizontal post member approximately three feet in length. As will be understood, such materials are relatively expensive. Moreover, such signs are necessarily relatively large and heavy, to the point that such signs cannot be conveniently transported in an ordinary automobile and, in any even, an average real estate agent has difficulty handling and erecting such signs. Accordingly, real estate brokerage firms typically hire an independent contractor to erect and take down such signs on-site at property listed by the firm, which of course further increases the overall expense associated with the use of such signs.

SUMMARY OF THE INVENTION

It is accordingly an object of the present invention to provide an outdoor support post apparatus suitable for use, among other things, as a real estate sales sign, which is relatively inexpensive in comparison with conventional signs and is particularly adapted for selective assembly and disassembly to facilitate repeated temporary use. It is a further object of the present invention to provide such a support post apparatus which is capable of easy erection and dismantlement by ordinary real estate sales personnel and ready transportability from one site to another in most any automobile or like vehicle.

Briefly described, the outdoor sign post apparatus of the present invention includes an anchor member for partial penetration in upright disposition in a selected support surface, such as a lawn or other earthen area, and a base post member having a longitudinal opening therethrough for receipt of the anchor member to support the base post member in upright disposition on the support surface. An extension post member is provided for telescopical mounting to the base post member in upright alignment therewith and a cross post member is provided for mounting to the extension post member in substantially transverse relationship thereto in disposition for supporting an article, e.g., a sign or like display, on the cross post member. For this purpose, the extension post member and the cross post member have matable notches formed therein for generally interlocking engagement therebetween.

In the preferred embodiment of the present support post apparatus, the base post member includes a tubular outer sheath and a central core extending longitudinally within the sheath and projecting outwardly from one end thereof to form an extension mounting end of the base post member of reduced cross-section with respect to the outer sheath. The extension post member similarly includes a tubular outer sheath of substantially the same tubular cross-section as the base member sheath, the extension-member sheath being hollow at a mounting end thereof for telescopical receipt of the sheath-member core at the extension mounting end of the base post member. The longitudinal opening in the base post member is formed centrally through the length of its core, the anchor member being preferably a linear bar adapted to be driven into the support surface. The extension post member also includes a central core disposed within the end of its sheath opposite the hollow end thereof. Similarly, the cross post member includes a tubular outer sheath, with first and second central cores respectively disposed within the opposite ends of the cross-member sheath. Preferably, the cores of the base, extension and cross post members are formed of wood to provide structural strength to the post apparatus and their sheaths are formed of plastic tubing for reduction of the overall weight of the post apparatus.

The matable notch of the extension post member is formed in its sheath and core at the end of the extension-member sheath opposite its hollow mounting end. Compatibly, the matable notch of the cross post member is formed in its sheath and one of its cores at one end of the sheath. The extension and cross post members are preferably of corresponding substantially square cross-sections with their matable notches being of corresponding substantially orthogonal configurations. The extension and cross post members have openings formed respectively therethrough at their notches for alignment of the openings upon mated engagement of the notches for receipt of a bolt or similar fastener to secure the extension and cross post members in transverse mounted relationship.

DESCRIPTION OF THE PREFERRED EMBODIMENT

Figure 1:
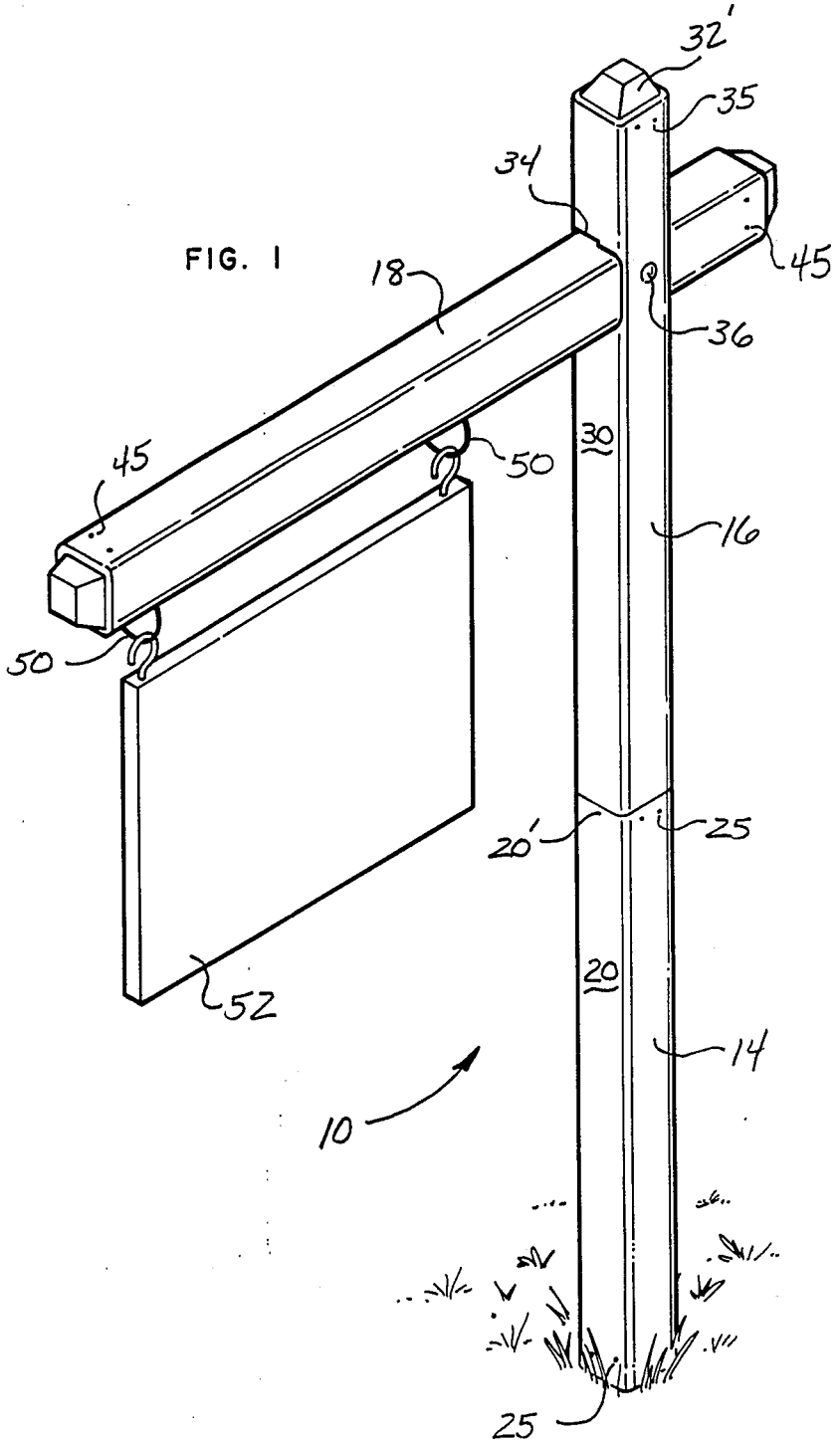
FIG. 1 is a perspective view of an outdoor sign post apparatus of the present invention as preferably embodied for use as a real estate sales sign.

Referring now to the accompanying drawings, and initially to FIG. 1, an outdoor sign post apparatus according to the preferred embodiment of the present invention is shown generally at 10. Basically, the sign post apparatus 10 includes an anchor member 12 (FIGS. 2 and 3), a base post member 14, an extension post member 16, and a cross post member 18.

The anchor member 12 is preferably a substantially linear metal rod or bar, such as a length of conventional angle-iron or a length of a conventional iron or steel concrete-reinforcing rod. As such, the anchor 12 is of a construction adapted to be driven by a conventional hammer or mallet into any earthen area, such as a grassy lawn, at a desired site for erection of the sign post apparatus 10.

Figure 2:
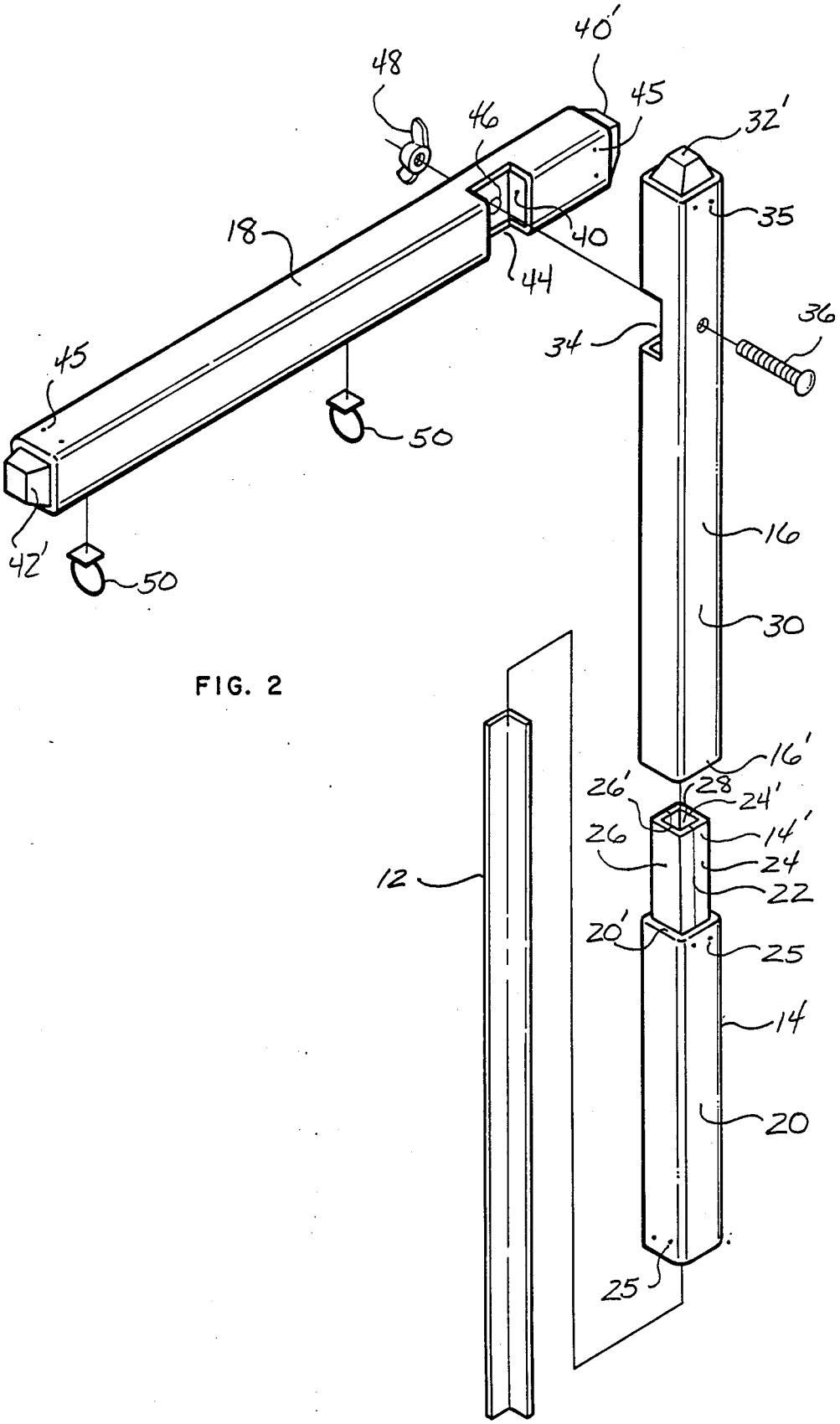
FIG. 2 is an exploded perspective view of the sign post apparatus of FIG. 1.
Figure 3:
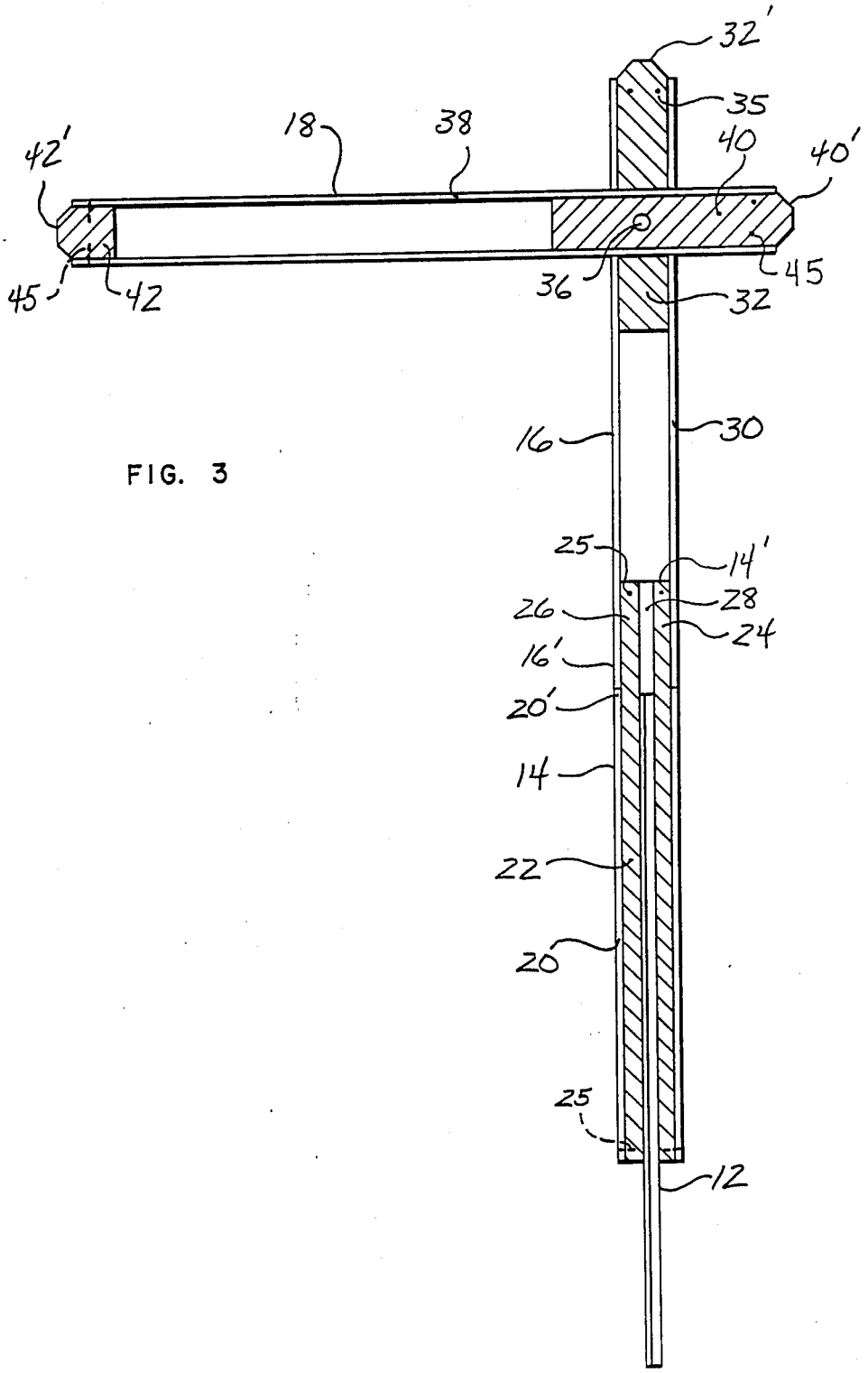
FIG. 3 is a vertical cross-sectional view through the sign post apparatus of FIG. 1.

As best seen in FIGS. 2 and 3, the base post member 14 includes a tubular outer sheath 20 with a central core 22 extending longitudinally within the sheath 20 to project outwardly from one end 20' thereof. The core 22 is preferably formed of a pair of conventional "two-by-four" wooden boards 24,26 affixed coextensively to one another in face-abutting relationship to form the core 22 of a substantially square cross-sectional shape. The wooden boards 24,26 of the core 22 should be of the type which have been chemically treated against decay and insect infestation. The sheath 20 is preferably a length of extruded plastic tubing of a compatible substantially square cross-sectional shape and size to closely fit annularly about the wooden core 22. Several brads 25 are driven through the upper and lower ends of the sheath 20 into the core 22 to secure them together as described. The core 22 is at least several inches (preferably approximately 6 inches) longer than the sheath 20 to leave a corresponding extent of the core 22 exposed at the upper end of the base post member 14 forming a mounting end 14' thereof a relatively reduced cross-sectional dimension. The facing surfaces of the wooden boards 24,26 of the core 22 are formed along their lengthwise center lines with mated facing mortises 24',26' which together form a central longitudinal opening 28 through the length of the base post member 14. The opening 28 is of a cross-sectional shape and size closely conforming to that of the anchor member 12 to enable the base post member 14 to be mounted on the anchor member 12 with the anchor member 12 snugly received lengthwise within the longitudinal opening 28.

The extension post member 16 also includes a tubular outer sheath 30 formed of a length of square plastic tubing substantially identical to the sheath 20 of the base post member 14. A central core 32, formed of a relatively shorter length of a conventional "four-by-four" treated wooden post, is snugly disposed within the extension-member sheath 30 at the upper end thereof. As with the base post member 14, several brads 35 are driven through the sheath 30 of the extension post member 16 into its core 32 to secure the core within the upper end of the sheath 30. To provide a pleasing appearance, the wooden core 32 preferably projects slightly beyond the upper end of the sheath 30 with each side surface of the core 32 being convergingly tapered as shown at 32'. The core 32 occupies only approximately one-third of the overall length of the sheath 30, thereby leaving hollow the remaining extent of the sheath 30 to its downward end. As such, the extension post member 16 is of relatively light weight, with its hollow lower end 16' formed by the sheath 30 being adapted to fit telescopically over the exposed core 22 at the upper mounting end 14' of the base post member 14 in substantial alignment therewith, with their respective sheaths 20,30 in coextensive end abutment.

A notch 34 of orthogonal configuration is formed perpendicularly in the sheath 30 and interior core 32 at one lengthwise side of the extension post member 16 adjacent its upper end. The notch 34 is preferably formed to a depth of approximately one-half the cross-sectional thickness of the extension post member 16. A conventional threaded bolt 36 is fixedly mounted in the extension post member 16 to extend centrally outwardly through the notch 34.

The cross post member 18 includes a tubular outer sheath 38 formed identically as the sheaths 20,30 from conventional extruded square plastic tubing, with a first central core 40 of a reduced length of a conventional "four-by-four" wooden post disposed within one end of the sheath 38 to occupy approximately one-third of the lengthwise extent thereof and with a second central core 42 also of a substantially shorter length of "four-by-four" post disposed within the opposite end of the sheath 38. Brads 45 are driven through the sheath 38 into each core 40,42 to secure the cores at the ends of the sheath 38 as described. The respective outwardly facing end portions of the cores 40,42 preferably extend slightly from the opposite ends of the sheath 38 and are convergingly tapered as shown at 40' and 42', to provide a neat appearance. As with the extension post member 16, the cross post member 18 is thus hollow for the substantial extent of its length between the first and second cores 40,42 so that the cross post member 18 is of a relatively light weight.

The cross post member 18 also includes a notch 44 of an orthogonal configuration formed perpendicularly through the sheath 38 and the first core 40 at one longitudinal side of the cross post member 18 to matably correspond to the notch 34. As with the notch 34 of the extension post member 16, the notch 44 is formed to a depth of approximately one-half the cross-sectional thickness of the cross post member 18. A bore 46 is formed transversely through the sheath 38 and the first core 40 to open centrally into the notch 44. Thus, the extension and cross post members 16,18 are adapted to be mounted to one another in substantially perpendicular relationship with their respective notches 34,44 mated in general interlocking engagement with the bolt 36 of the extension post member 16 received in the bore 46 of the cross post member 18. A wing nut 48 is provided for threaded engagement on the distal end of the bolt 36 to secure the extension and cross post members 16,18 in such mounted relationship. A pair of hook members 50 are affixed in longitudinally-spaced relationship to the underside of the cross post member 18 generally beneath the hollow interior area thereof to facilitate the hanging of any desired sign, such as sign 52, from the cross post member 18.

As will thus be understood, the sign post apparatus 10 is readily capable of easy assembly and disassembly as desired. When disassembled, the anchor, base post, extension post, and cross post members 12,14,16,18, as well as any sign 52 used therewith, are of course separate components which may be conveniently arranged for storage and transportation as desired, either in the trunk or the interior passenger area of virtually any conventional automobile or passenger vehicle. Further, each component weighs no more than a few pounds so as to be no burden to carry. In order to erect the sign post apparatus 10, the anchor 12 is initially driven in an upright disposition into the earth at a desired location to a sufficient depth, usually approximately twelve inches, to substantially stabilize the anchor 12. Thereupon, the base post member 14 is mounted on the anchor member 12 by slidable insertion of the upright exposed extent of the anchor 12 into the longitudinal opening 28 through the central core 22 of the base post member 14, with the sheathed extent of the base post member 14 downwardly and the exposed core 22 at the mounting end 14' upwardly. The hollow lower end 16' of the extension post member 16 is then telescopically mounted on the upper mounting end 14' of the base post member 14 with its exposed core 22 received snugly within the lower extension post end 16' and the respective upper and lower ends of the sheaths 20,30 of the base and extension post members 14,16 in coextensive endwise abutment. Next, the cross post member 18 is oriented horizontally with respect to the extension post member 16 to bring their respective notches 34,44 into mated interlocking engagement with the bolt 36 of the extension post member 16 received through the bore 46 of the cross post member 18. The wing nut 48 is secured threadedly to the outwardly exposed end of the bolt 36 to secure the extension and cross post member 16,18 in such engagement. Finally, the sign 52 is hung from the hooks 50 of the cross post member 18 to complete the erection process. The sign post apparatus 10 is taken down and disassembled by reversing the described steps of the assembly process.

Advantageously, the sign post apparatus 10 of the present invention is sufficiently lightweight and easy to handle and transport to readily facilitate the erection and dismantlement of the apparatus 10 by virtually any real estate sales agent, as has traditionally been one of the functions of the agent, thus enabling brokerage firms to avoid any necessity of hiring outside contractors to transport, erect and take down real estate sales signs. As an attendant advantage, the sign post apparatus 10 is less likely than conventional signs to be damaged during the erection and dismantling processes and should therefore have a considerably longer useful life than conventional signs. The sign post apparatus 10 limits the use of wooden board and post members to only such locations in the post members requiring structural reinforcement and strengthening and thereby minimizes the use of such relatively expensive and heavy materials.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

That which is claimed is:

1. An outdoor support post apparatus adapted for selective assembly and disassembly for ease of erection and dismantlement and ready transportability during non-use to facilitate repeated temporary use, said apparatus comprising an anchor member for partial penetration in upright disposition in a selected support surface, a base post member having a longitudinal opening therethrough for receipt of said anchor member to support said base post member in upright disposition on said support surface, an extension post member for mounting to said base post member in upright alignment therewith, and a cross post member for mounting to said extension post member in substantially transverse relationship thereto for supporting an article on said cross post member, each of said base, extension and cross post members having a relatively lightweight tubular outer sheath and a central structural strengthening core extending longitudinally within a predetermined extent of said sheath.

2. An outdoor support post apparatus according to claim 1 and characterized further in that said base post member includes an extension mounting end of reduced cross-section and said extension post member includes a mating mounting end of a compatibly hollow tubular cross-section adapted for telescopical receipt of said extension mounting end of said base post member.

3. An outdoor support post apparatus according to claim 2 and characterized further in that said central core of said base post member projects outwardly from one end thereof to form said extension mounting end of said base post member and said tubular outer sheath of said extension post member is of substantially the same tubular cross-section as said base-member sheath and is hollow at one end to form said mating mounting end of said extension post member.

4. An outdoor support post apparatus according to claim 3 and characterized further in that said longitudinal opening of said base post member is formed centrally through the length of said base-member core and said anchor member is a linear bar adapted to be driven into said support surface.

5. An outdoor support post apparatus according to claim 3 and characterized further in that said central core of said extension post member is disposed within the end of said extension-member sheath opposite said hollow end thereof.

6. An outdoor support post apparatus according to claim 5 and characterized further in that said cross post member includes first and second central cores respectively disposed within the opposite ends of said cross-member sheath.

7. An outdoor support post apparatus according to claim 6 and characterized further in that said extension post member and said cross post member have matable notches formed therein for generally interlocking engagement therebetween.

8. An outdoor support post apparatus according to claim 7 and characterized further in that said matable notch of said extension post member is formed in its said sheath and core at said opposite end of said extension member sheath and said matable notch of said cross post member is formed in its said sheath and one of its said cores at one end thereof.

9. An outdoor support post apparatus according to claim 8 and characterized further in that said extension post member and said cross post member are of correspondingly substantially square cross-sections and their said matable notches are of corresponding substantially orthogonal configurations.

10. An outdoor support post apparatus according to claim 9 and characterized further in that said extension post member and said cross post member have openings formed respectively therethrough at their notches for alignment of said openings upon mated engagement of said notches for receipt of bolt means through said openings to secure said extension and cross post members in transverse mounted relationship.

11. An outdoor support post apparatus according to claim 1 and characterized further in that said cores of said base, extension and cross post members are formed of wood to provide structural strength to said post apparatus and said sheaths thereof are formed of plastic tubing for weight reduction of the overall weight of said post apparatus.

12. An outdoor support post apparatus according to claim 1 and characterized further in that said extension post member and said cross post member have matable notches formed therein for generally interlocking engagement therebetween.

13. An outdoor support post apparatus according to claim 12 and characterized further in that said extension post member and said cross post member are of correspondingly substantially square cross-sections and their said matable notches are of corresponding substantially orthogonal configurations.

14. An outdoor support post apparatus according to claim 13 and characterized further in that said extension post member and said cross post member have openings formed respectively therethrough at their notches for alignment of said openings upon mated engagement of said notches for receipt of bolt means through said openings to secure said extension and cross post members in transverse mounted relationship.

* * * * *